US005502788A

United States Patent [19]

Platsch

[11] Patent Number: 5,502,788

[45] Date of Patent: Mar. 26, 1996

[54] RADIANT-HEAT DRIER STRIP WITH COOLING AIR DISTRIBUTOR ELEMENT

[76] Inventor: Hans G. Platsch, Kupferstr. 40, D-70565 Stuttgart, Germany

[21] Appl. No.: 169,629

[22] Filed: Dec. 20, 1993

[30] Foreign Application Priority Data

Dec. 24, 1992 [DE] Germany ..... 42 44 003.3

[51] Int. Cl.[6] ..... B41F 23/04

[52] U.S. Cl. ..... 392/424; 392/379; 392/417; 101/424.1; 432/233; 34/585; 34/274

[58] Field of Search ..... 392/424, 417, 392/407, 379; 219/388, 505; 355/286, 285; 34/1 W, 1 B, 41, 48, 273, 274, 278, 579, 585; 101/424.1; 432/233; 156/583.5, 583.1

[56] References Cited

U.S. PATENT DOCUMENTS

| | | | |
|---|---|---|---|
| 3,900,959 | 8/1975 | Breschi et al. | 34/639 |
| 4,267,005 | 5/1981 | Barnaby | 156/380.9 |
| 4,295,826 | 10/1981 | Vasilantone | 432/233 |
| 4,494,316 | 1/1985 | Stephansen et al. | 34/41 |
| 4,535,548 | 8/1985 | Hyde | 34/4 |
| 4,658,512 | 4/1987 | Fleissner | 34/625 |
| 4,727,655 | 3/1988 | Jacobi, Jr. | 34/266 |
| 5,070,626 | 10/1991 | Jurgen | 34/41 |
| 5,099,586 | 3/1992 | Anderson | 34/68 |
| 5,101,578 | 4/1992 | Swanson | 34/623 |
| 5,117,562 | 6/1992 | Dulay et al. | 34/550 |
| 5,159,763 | 11/1992 | Platsch | 34/41 |

FOREIGN PATENT DOCUMENTS

| | | | |
|---|---|---|---|
| 0109547 | 5/1984 | European Pat. Off. . | |
| 0141227 | 5/1985 | European Pat. Off. . | |
| 1449350 | 7/1966 | France . | |
| 1124432 | 2/1962 | Germany . | |
| 2402435 | 7/1975 | Germany . | |
| 3317714 | 12/1983 | Germany . | |
| 3707860 | 10/1988 | Germany | 219/388 |
| 3744799 | 6/1989 | Germany . | |
| WO92/18693 | 10/1992 | WIPO . | |

*Primary Examiner*—John A. Jeffery
*Attorney, Agent, or Firm*—Lowe, Price, LeBlanc & Becker

[57] ABSTRACT

A radiant-heat drier for printing presses or the like has a plurality of spaced radiant-heat drier strips (22) which extend transversely with respect to the conveyance direction and which each have in turn a radiator bar (44) and a cooling air distributor element (24) extending parallel thereto at a distance. On a wall (30) facing the radiator bar (44), the radiator bar has a plurality of air delivery nozzles (32, 34) which terminate in the immediate vicinity of the rear of the radiator element (44).

5 Claims, 3 Drawing Sheets

RADIANT-HEAT DRIER STRIP WITH COOLING AIR DISTRIBUTOR ELEMENT

FIELD OF THE INVENTION

The invention relates to a radiant-heat drier strip and to a radiant-heat drier comprising such a strip.

BACKGROUND OF THE RELATED ART

Infrared radiant-heat driers are extensively used for drying printing inks, lacquers and the like. They contain bar-shaped radiator elements which usually comprise a transparent envelope and two electrically heated wires which are disposed in the latter and are the actual source of radiation. The rear of the envelopes is often coated with gold by vapour deposition in order, on the one hand, to radiate as large a proportion as possible of the radiation to the products to be dried and, on the other hand, to minimize undesirable heating of other parts of the appliance. The outputs of such radiator elements are up to 60 $W.cm^{-1}$, and these powers hitherto necessitated an efficient cooling of the radiation drier strips; air cooling was adequate only for radiator elements having low powers of, for example, 25 to 45 $W.cm^{-1}$.

SUMMARY OF THE DISCLOSURE

The present invention seeks to develop a radiant-heat drier strip so that it can be equipped with radiator elements of the order of magnitude of 60 $W.cm^{-1}$, but can nevertheless be entirely or at least mainly air-cooled.

Accordingly, the invention provides a radiant-heat drier strip in which the cooling device has a cooling-air distributor element which extends in parallel at a distance from the radiator element and which supports, on a wall facing the radiator element, two parallel rows of air delivery nozzles which have been placed in the vicinity of that side of the radiator element which faces the distributor element.

The radiant-heat drier strip according to the invention has air delivery nozzles which have been placed at a short distance immediately in front of the rear of the radiator elements and which each deliver a well-focused jet of air. In this way, high flow velocities in the immediate vicinity of the radiator elements and, consequently, a good heat removal from the surfaces directly subjected to flow are obtained. At the same time, the well-focused jets of air very effectively entrain the volumes of air situated behind the radiator element in accordance with the principle of the water-jet pump. The heat absorbed by the cooling air is thus also rendered usable for heating the products.

Further advantages of the radiant-heat drier strip according to the invention are a mechanically very simple structure and a very compact design.

Preferably, the air delivery nozzles of the two rows of nozzles follow one another in each case at regular intervals and the nozzles in the two rows of nozzles are offset by half a spacing with respect to one another.

This has the advantage with regard to a mechanical action on the product to be dried, which action is completely uniform in the longitudinal direction of the strip.

Preferably, the two ends of the distributor element are provided with an air feed. This ensures that essentially uniform cooling of the different axial sections of the radiator element is obtained with structurally simple means.

Preferably, the distance between the radiator element and the adjacent wall of the distributor element is small. This has the advantage that the volumes of air situated behind the radiator element are only small, with the result that, for a given intensity of the water-jet suction removal of said volumes of air, a particularly intensive exchange of air takes place.

The compact transverse dimensions of the radiant-heat drier strip according to the invention make it possible to assemble the latter to form a radiant-heat drier leaving large gaps free, which radiant-heat drier can be accommodated in the volume normally provided for this purpose in a printing press. It is therefore preferred that the radiant-heat drier strips are mounted on a frame at a distance from one another which is large compared with the width of the distributor elements. Such a drier has the advantage that there is, in its interior, a substantially unimpeded free access for air to the surface of the products to be dried. This is advantageous with regard to promoting oxidation reactions which are initiated in the radiant-heat drier in the inks to be dried and which also proceed to an appreciable extent in said drier.

DETAILED DESCRIPTION OF THE PREFERRED EMBODIMENTS

Figure 1:
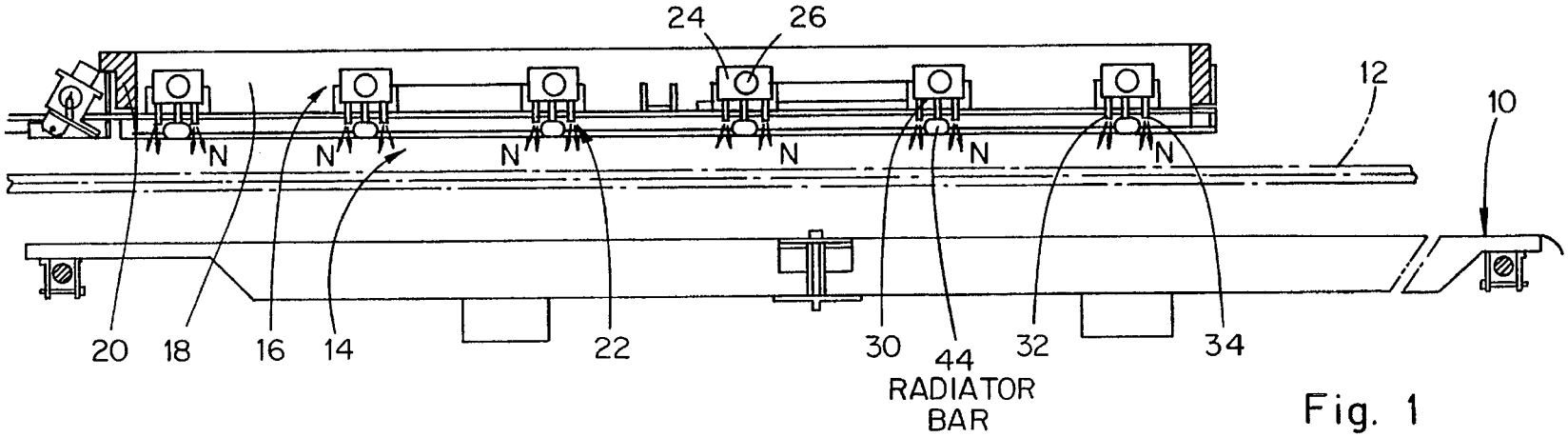
FIG. 1 shows a longitudinal section through a radiant-heat drying station of a printing press.
Figure 2:
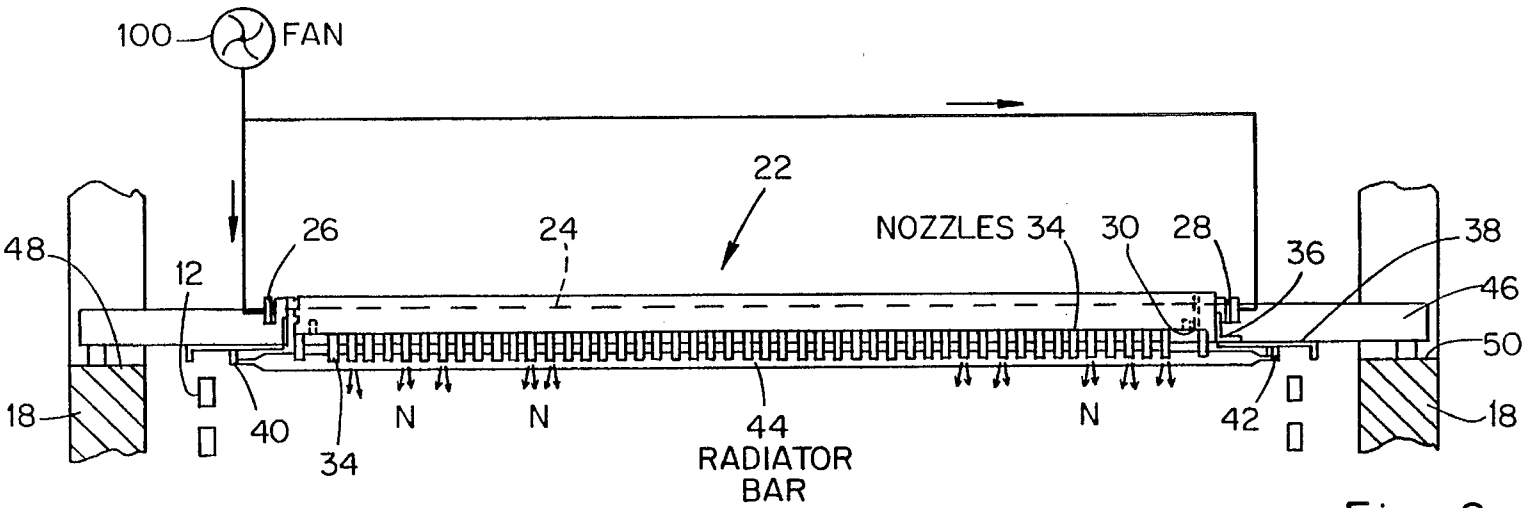
FIG. 2 shows a side view of one of the radiant-heat drier strips of a radiant-heat drier shown in FIG. 1.

In FIG. 1, the numeral 10 denotes a sheet guide plate above which a working strand 12 of a conveyor chain is indicated which conveys individual printed sheets in the normal manner using grippers. Disposed above the sheet guide plate 10 is a radiant-heat drier which is denoted as a whole by 14 and which has an open frame having longitudinal struts 18 and transverse struts 20. Attached to the longitudinal struts 18 are radiant heat drier strips denoted as a whole by the numeral 22.

The latter have a distributor element 24 which has a rectangular cross section and whose end faces are provided with connecting pipes 26, 28 connected to a fan 100.

A lower wall 30 of the distributor element 24 supports at the front end a series of tubular nozzles 32 which follow one another at regular intervals. At the rear edge of the wall 30, nozzles 34 are provided at the same interval, but offset by half a spacing.

Figure 3:
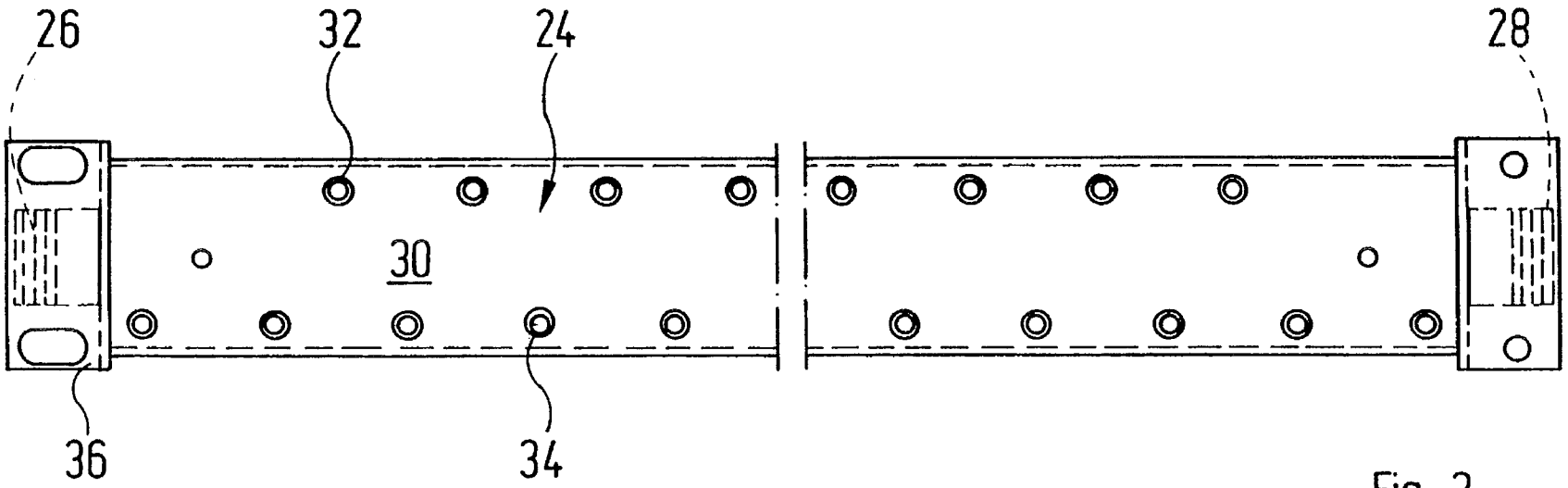
FIG. 3 shows a view of the bottom of the radiant-heat drier strip shown in FIG. 2 on an enlarged scale, a radiator bar having been removed for the purpose of better clarity.
Figure 4:
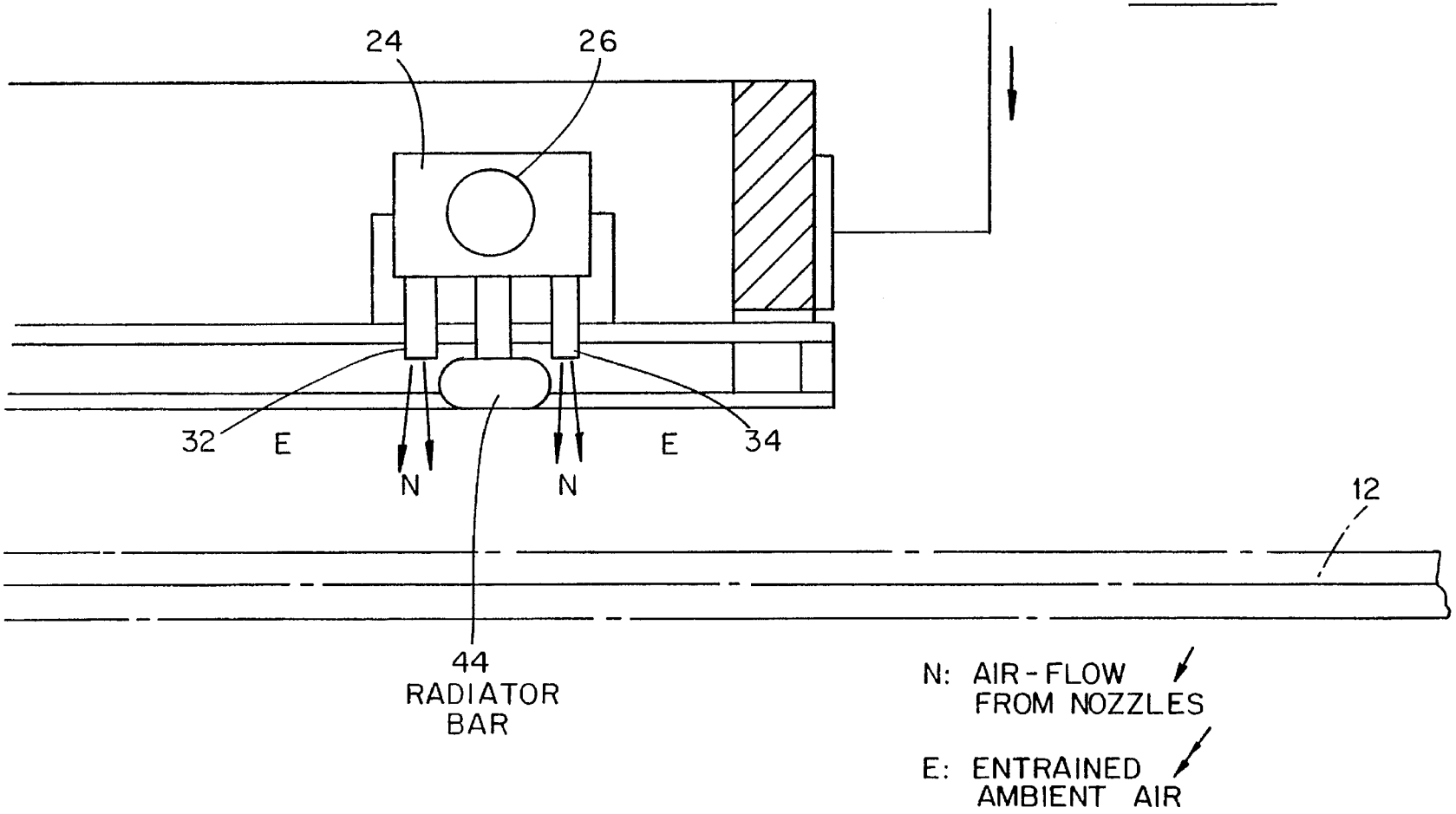
FIG. 4 shows an enlarged view of a portion of the structure of FIG. 1, to identify air flows from certain nozzles and entrained airflow generated thereby.

As best understood with reference to FIGS. 1 and 3, the nozzles 32 and 34 are spaced out in two respective parallel rows which bracket the radiator bar 44. The delivery end of each nozzle (both 32 and 23), as best seen in the enlarged view per FIG. 4, is located at a short distance immediately in front of the rear of the corresponding radiator element so as to deliver a well-focused jet of air. This entrains air from the space immediately behind the radiator element 44 and thus cools the radiator element. Heat contained in this entrained air is then beneficially delivered to the objects being dried by the IR radiation directed forwardly of the radiator element 44.

Fixtures 40, 42 which hold an IR radiator bar 44 are mounted on the end faces of the distributor elements 24 by means of holding brackets 36, 38. The IR radiator bar has an essentially oval cross-section and contains two heating wires, which are not shown in the drawing and which extend in parallel with one another, and a transparent heat-resistant envelope. The latter is coated with gold in the section facing the distributor element 24.

The distributor element 24 constructed as described above is in turn linked to a support 46, whose ends are positioned and mounted in recesses 48, 50 of the two longitudinal struts 18 of the frame 16.

During the operation of the radiant-heat drier a flow of cooling air is provided to distributor element 24 by fan 100 and thence to nozzles 32 and 34. Jets of air are delivered by the nozzles 32, 34 entrain ambient air and, owing to the proximity of the nozzle ends to the upper lateral sections of the radiator bars 44, the space situated above the radiator bars is subjected to suction as a result of water-jet pump action. There is therefore also a very effective movement of cooling air in said space. The heat entrained by the cooling air is delivered to the products to be irradiated when said air strikes the latter.

It is furthermore evident that, between the radiant-heat drier strips, which are very compactly assembled in the transverse direction, a large amount of free space in which ambient air can reach the surface of the products to be irradiated is left in the product conveyance direction. A good supply of oxygen for oxidation reactions which proceed in printing inks for the purpose of curing is thus obtained.

In this disclosure, there are shown and described only the preferred embodiments of the invention, but, as aforementioned, it is to be understood that the invention is capable of use in various other combinations and environments and is capable of changes or modifications within the scope of the inventive concept as expressed herein.

We claim:

1. A radiant-heat drier strip for a radiant-heat drier for use in printing presses or coating machines, comprising:

a bar-shaped IR radiator element and an associated fixture; and a cooling device adapted to be connected to a fan, in which the cooling device has a cooling-air distributor element which extends parallel to, and at a distance from, the radiator element and which supports, on a wall facing the radiator element, two parallel rows of air delivery nozzles distributed lengthwise of the radiator element and which have been placed in the vicinity of that side of the radiator element which faces the distributor element.

2. The radiant-heat drier strip according to claim 1, wherein:

the air delivery nozzles in each of the two rows of nozzles are equally spaced apart from each other in substantially a straight line parallel to a longitudinal axis of the distributor element, and each of the nozzles in one of the two rows is offset in a transverse direction relative to the nozzles in the other of the two rows by a distance which is half of the longitudinal spacing distance separating adjacent nozzles in the respective rows.

3. The radiant-heat drier strip according to claim 1, wherein:

the two ends of the distributor element are provided with an air feed.

4. The radiant-heat drier strip according to claim 1, wherein:

the distance between radiator element and the wall of the distributor element is such as to enable removal of air from a space defined between the radiator element and the wall of the distributor element by entrainment with flow from the air delivery nozzles.

5. A radiant-heat drier comprising a plurality of radiant-heat drier strips according to claim 1, wherein:

the radiant-heat drier strips are mounted on a frame at a distance from one another, which distance is larger than a width of the distributor elements.

* * * * *